US006324775B1

(12) United States Patent
Harnois et al.

(10) Patent No.: US 6,324,775 B1
(45) Date of Patent: Dec. 4, 2001

(54) FOLDING BLADE

(75) Inventors: Normand Harnois, St-Valerien de Milton; Bertrand Houle, Drummondville; Yannick Morin, St-Felix-de-Kingsey, all of (CA)

(73) Assignee: 177197 Canada LTEE (CA)

( * ) Notice: Subject to any disclaimer, the term of this patent is extended or adjusted under 35 U.S.C. 154(b) by 0 days.

(21) Appl. No.: 09/468,875

(22) Filed: Dec. 22, 1999

(51) Int. Cl.[7] ..... E02F 3/76
(52) U.S. Cl. ..... 37/266; 172/781; 172/795
(58) Field of Search ..... 172/780, 781, 172/789, 795; 37/266, 267, 234, 241, 381, 279

(56) References Cited

U.S. PATENT DOCUMENTS 3,086,303 * 4/1963 Weeks ..... 37/42
4,148,365 * 4/1979 Anderson ..... 172/781
4,161,987 * 7/1979 Tolmer ..... 172/791
4,304,307 * 12/1981 Anderson ..... 172/791
4,665,636 * 5/1987 Borras ..... 37/234
5,782,016 * 7/1998 Feller et al. ..... 37/384
5,813,150 * 9/1998 Feller et al. ..... 37/234
6,123,156 * 9/2000 Dufour et al. ..... 172/795
6,129,156 * 10/2000 Boast et al. ..... 172/4.5

* cited by examiner

*Primary Examiner*—Thomas B. Will
*Assistant Examiner*—Kristine Markovich
(74) *Attorney, Agent, or Firm*—David J. French

(57) ABSTRACT

A mid-chassis, underbody plow or scrapper blade is mounted under a vehicle chassis to be folded upwardly for storage when not in use. The blade is also mounted to permit the outer ends of the blade to move vertically. Pneumatic pressure actuators mounted on either side of the center line of the vehicle apply pressure through pivot arms to the respective ends of the blade to control the scrapping action. The support structure for the blade swings upwardly to achieve a two-stage storage which increases the elevation of the blade when folded.

20 Claims, 10 Drawing Sheets

3
2
6b
7
13a
7
6a
14a
49a
15
13b
6
14b
30
49b
31
32
5
4

FOLDING BLADE

FIELD OF THE INVENTION

This invention relates to plowing equipment. More particularly, it relates to a support system for a mid-chassis, underbody plow or scrapper system that controls the deployment of a blade and its storage beneath the vehicle for deployment. The invention is suited especially for installation on the underbody of trucks for use as snow plows.

BACKGROUND TO THE INVENTION

Mid-chassis or underbody plows and scrappers are well known vis. U.S. Pat. Nos. 4,031,966; 4,337,832. Such plows have been designed to fold upwardly for storage, c.f. U.S. Pat. No. 4,031,966 depicting rearward folding.

In designing an underbody plow or scrapper with a folding blade it is desirable to provide adjustability to raise or lower the blade, and to tilt the blade, raising its outer ends up and down about a horizontal axis that is generally pointed outwardly from the blade surface. Blades are often required to be angled to the left and right about a vertical axis. It is also desirable when the plow blade is light, to provide a supplementary force-control mechanism that will apply a downward force to the plow blade to maintain it in contact with the surface being plowed with the appropriate level of pressure. It would be highly desirable to combine these features with an under body plow having a storage feature that would permit it to be raised above the road surface when not deployed.

These features of control should ideally be achievable, in whole or in part, at minimal cost and with a minimal addition of weight to the vehicle.

It is therefore an object of the invention to provide an underbody blade support system that has various combinations of the above features combined with simplicity and low cost.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention employs a plow assembly incorporating an underbody plow blade or scrapper with a mold board and two outer ends, (hereafter referred to generally as a scrapper blade) which is mounted to extend generally transversely beneath the chassis of a vehicle. This scrapper blade is positioned between the forward and rearward sets of wheels on the vehicle and may be angled to be oriented to the left or right while still extending generally transversely beneath the vehicle.

A feature of the invention is that the blade may be folded, preferably forwardly, to raise it above the road surface in a stored position. In its folded orientation, the mold board of the plow is upwardly directed. Preferably, rotation of the mold board from its deployed position is effected about a hinge line that is rearwardly of and intermediate the top and bottom edges of the mold board. The top edge may, in being folded, retire from a first deployed rotational stop means to a second folded stop means against which the top edge may bear.

Preferably, the blade-folding system of the invention is carried by an elevating support to cause the folded blade to retire upwardly. Thus, in a preferred arrangement, the blade may be carried at the end of a pivot arm assembly in the form of two trailing arms that are mounted to the chassis so as to extend downwardly from a forwardly-mounted hinge mount. The upper edge of the mold board may nest in a recess formed in the pivot arms. The pivot arm assembly hinge mount allows rotation of the pivot arm assembly about an axis that is also generally transverse to the direction of motion of the vehicle. Other means of supporting and elevating the blade are, however, permissible, in order to provide this two-stage storage effect.

The scrapper blade is preferably tiltable in the sense that one of its two outer ends may be elevated vertically with respect to the other end. This may be effected in one preferred manner by providing a rotatable coupling between the vehicle chassis, e.g. within the pivot arm assembly, and the scrapper blade that allows the scrapper blade to rotate about a generally horizontal axis extending forwardly and rearwardly beneath the vehicle. Other means of providing for such freedom of motion may also be employed, including independently hinged pivot arms.

Preferably the scrapper blade with its scrapping edge is positioned against a road surface by two pressure actuators respectively located between the blade and the vehicle chassis at spaced locations on either side of the centerline of the vehicle. These pressure actuators may be in the form of pneumatic bladders to apply a resilient downward pressure on the scrapper blade through the elevating support. In the case of the use of a pivot arm assembly, the pressure actuators may be positioned between the chassis and the pivot arms.

As an optional feature, by independent control of the pressure actuators, differing vertical forces may be applied to the respective outer ends of the scrapper blade. Consequently a greater amount of contact pressure may be maintained between the scrapper blade and the surface being scrapped at one outer end of the blade than at the other outer end. This greatly facilitates the removal of snow, ice or other debris from a road surface when the level of material to be removed is higher on one side of the vehicle than on the other side of the vehicle.

The preferred type of pressure activator is a pneumatic bladder of the type generally employed in air springs. Their role is to press the blade edge resiliently against the road surface, lifting-off ice, snow and debris from that surface. Such devices are not only relatively inexpensive, but also provide a "spring" resilience that allows the scrapper to move vertically to accommodate vertical variation in the surface being scrapped.

To complement the folding action by which the scrapper blade is raised for storage above the road surface, the elevating support, e.g. the pivot arm assembly, may be provided with a blade folding actuator coupled between the pivot arm assembly and the vehicle chassis to serve as well as a lifting actuator. Action as a lifting actuator may be achieved in conjunction with the folding of the blade by providing a lifting link, such as a chain, that extends between a folding portion of the blade and the vehicle chassis.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
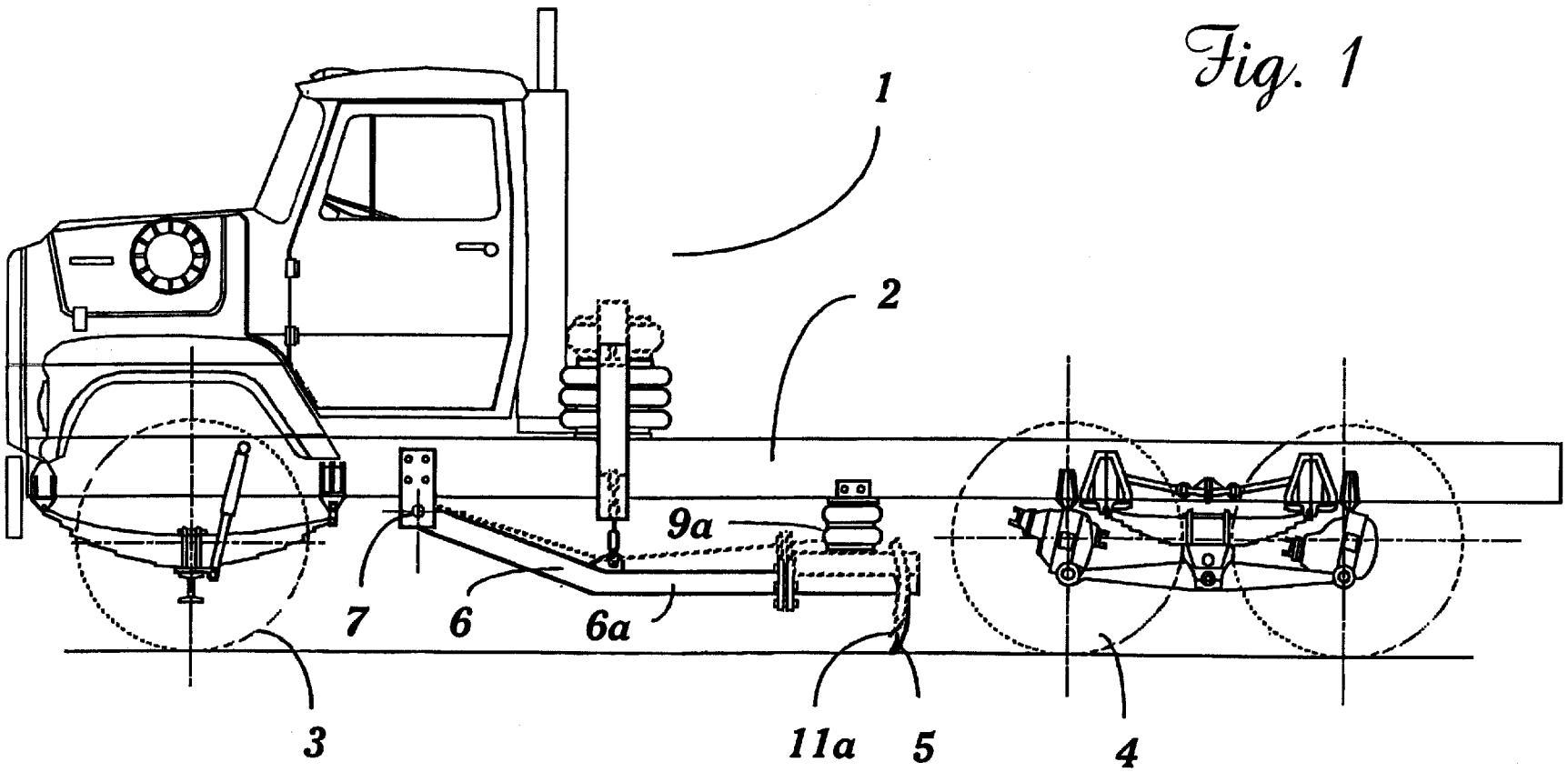
FIG. 1 is a side view of a prior art vehicle carrying a mid-chassis, underbody plow blade carried by a pivot arm assembly that serves as one aspect of a preferred variant of the invention when combined with a folding plow blade.

In FIG. 1 a vehicle 1 having a chassis 2, forward wheels 3 and rearward wheels 4 carries between these sets of wheels 3,4 a scrapper blade or plow blade 5. While reference hereafter will be made to a "blade" 5 this language is intended to encompass any form of scrapper blade, including rake and chisel-like constructions.

FIG. 1 is prior art. However, FIG. 1 will be described in detail because it provides a synergistic environment for the folding blade feature of the invention.

The blade 5 is carried by a pivot arm assembly 6 having two pivot arms 6*a*, 6*b* that trail below the chassis 2 from pivot arm hinges 7 coupled to the chassis 2 at the forward end of each pivot arm 6*a*,6*b* serving as chassis mounting means. The hinges pivot arm 7 permit rotation of the pivot arms 6*a*,6*b* about an axis that is transverse to the direction of the vehicle 1. The pivot arms 6*a*,6*b* may be mounted to rotate independently (not shown) to permit the blade 5 to tilt. An alternate, preferred tilting arrangement is detailed further, below.

Positioned between the chassis 2 and blade 5 are two pneumatic bellows 9*a*,9*b* respectively mounted on opposite sides of the centerline 10 of the vehicle 1. Based on pneumatic springs, these bellows 9*a*,9*b* act as controllable pressure actuators which are able, in a preferred arrangement, to apply independently differing pressures to the outer ends 11*a*,11*b* of the blade 5.

A preferred structure for allowing the blades to tilt, i.e. to effect vertical displacement of the outer ends 11*a*, 11*b* of the blade 5, is shown in FIGS. 2–5. For simplicity of depiction, the blade folding feature of the invention is not shown in FIGS. 2–5. Tilting is effected by the presence of a rotary coupling 12 incorporated into a pair of transverse tilting plates 13*a*,13*b*. A first one of these plates 13*a* extends between the pivot arms 6*a*,6*b*; the second of these plates 13*b* extends between two blade support arms 14*a*, 14*b* that connect to the blade 5. A central pin 15 coupled to the two tilting plates 13*a*,13*b* permits rotation of the blade support arms 14*a*, 14*b* and blade 5 about a horizontal axis that is generally aligned with the direction of travel 10 of the vehicle 1.

The plates 13*a*, 13*b* preferably are positioned closely together so that their outer ends may brush together to absorb dislocating forces that tend to swivel the blade 5 to the left or right. As well, welded pins or bolts 45 may extend from the ends of one plate 13*a* to carry containment plates 46 that contain or "trap" the outer ends of the second plate 13*b* (or in the reverse arrangement extending from the second plate 13*b* to contain the first plate 13*a*). This is to absorb tensional forces while permitting rotation between the plates 13*a*,13*b*. Specific bearing surfaces may be provided with respect to each of the plates 13*a*,13*b* to absorb the brushing contact action.

Figure 2:
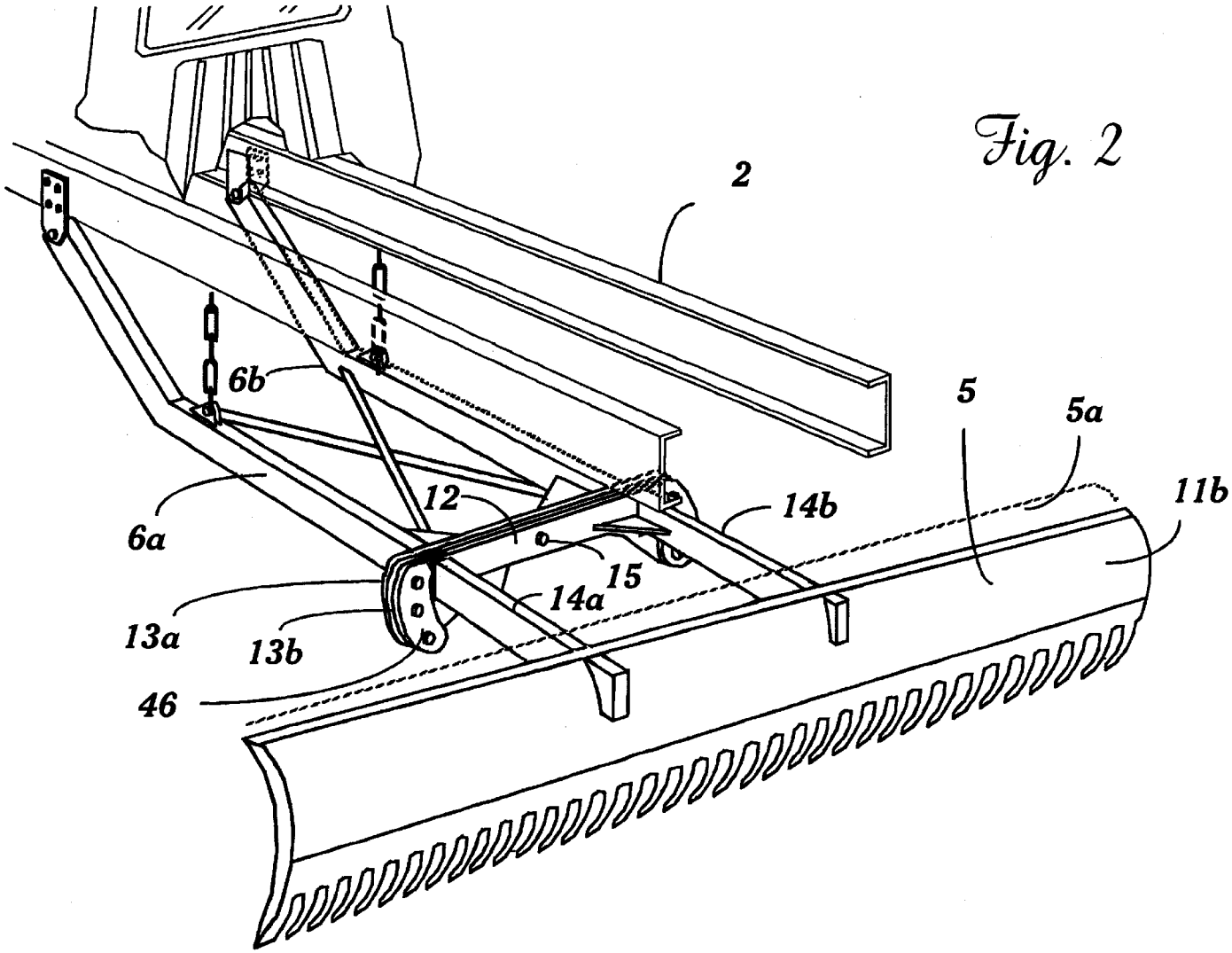
FIG. 2 is a perspective view of a cut-away portion of the vehicle of FIG. 1 taken from the left rear quarter with the pneumatic actuators omitted for clarity.

In FIG. 2 the alternate position of the tilted blade 5 is shown in ghost outline 5*a* with one end 11*b* raised and the other end 11*a* lowered.

Figure 3:
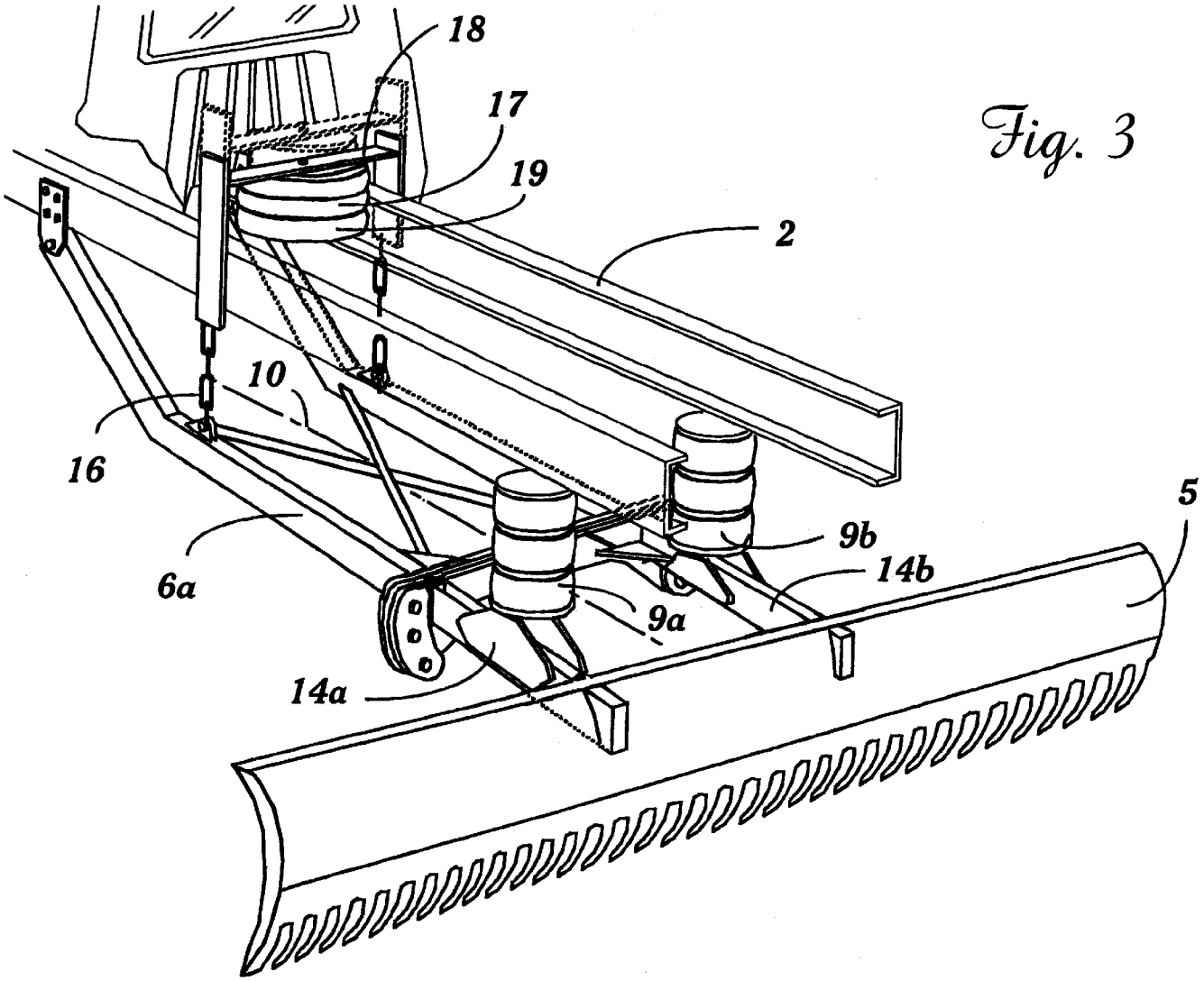
FIG. 3 is the view of FIG. 2 with pneumatic actuators depicted in position.

In FIG. 3 the pneumatic bellows 9*a*,9*b* omitted from FIG. 2 for clarity are shown positioned to apply force between the chassis 2 and the blade 5 through the respective blade support arms 14*a*, 14*b*. These pressure actuators 9*a*,9*b* are spaced apart and positioned to apply similar or differing pressures at the outer ends of the blade 5 in pressing the blade downward onto a road surface 36.

The pivot arm assembly 6 may be raised by chains 16 descending from a frame 17 that includes a transverse bar 18 that overlies a further air spring lifting bellows 19 positioned on the chassis 2. The pivot arms 6*a*, 6*b* according to this lifting arrangement are coupled to the chains 16 at locations between their ends to provide the action of a third class lever.

Figure 4A:
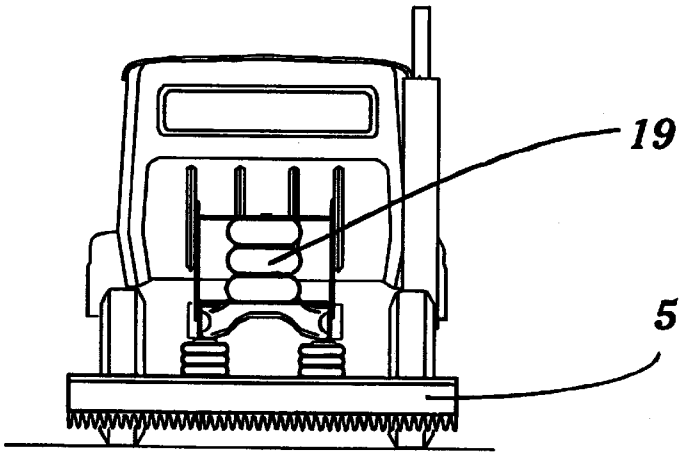
FIG. 4*a* is a rearward view of the vehicle of FIG. 1 with the pivot arm assembly raised.
Figure 4B:
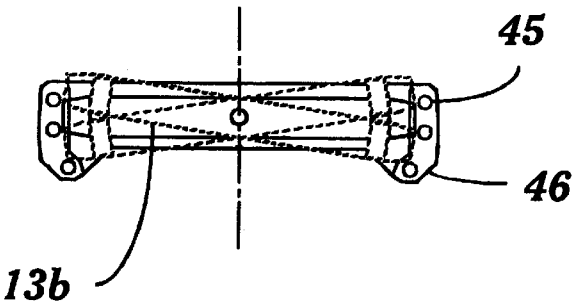
FIG. 4*b* shows a rearward face view of the tilting plate assembly.
Figure 4:
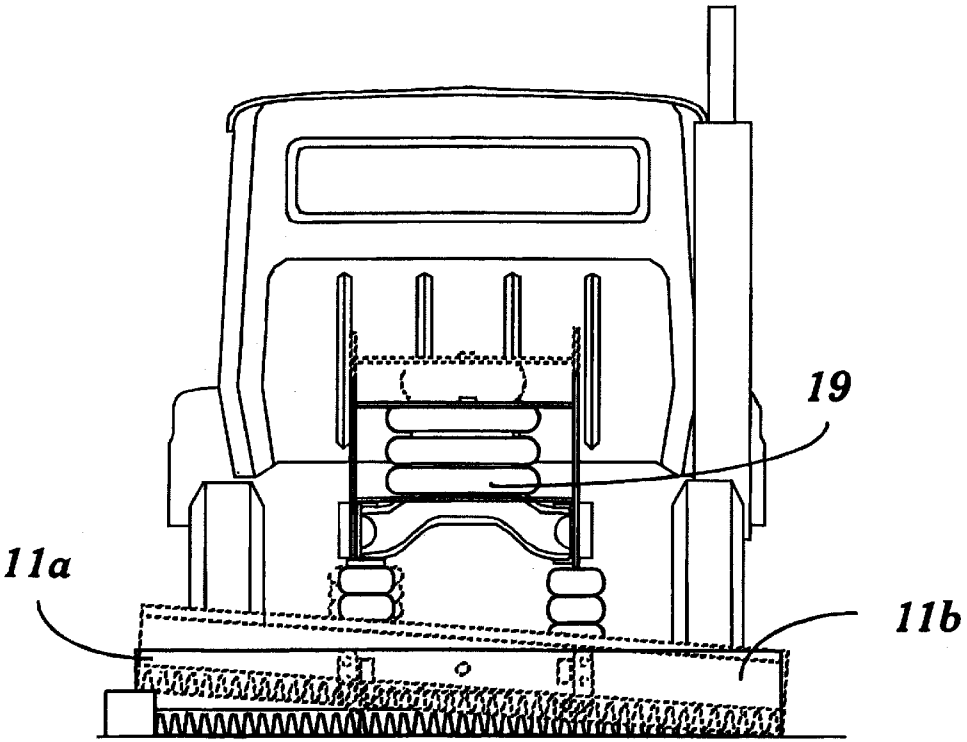
FIG. 4 is a rear-end view of the vehicle of FIG. 1 with the pivot arm assembly lowered.

To raise the blade 5, the pressure in the pressure actuator bellows 9*a*,9*b* is released (through valves 24) and that in the lifting bellows 19 is increased. The force of the lifting bellows 19 is transmitted through the frame 17 and chains 16 to the pivot arm assembly 6 raising the blade 5 upwardly off of the surface being scrapped. This operation may be seen in FIGS. 4 and 4*a* wherein the pivot arm assembly 6 is respectively lowered and raised. An alternate lifting arrangement may be employed with the folding-blade configuration, described further herein.

Figure 5:
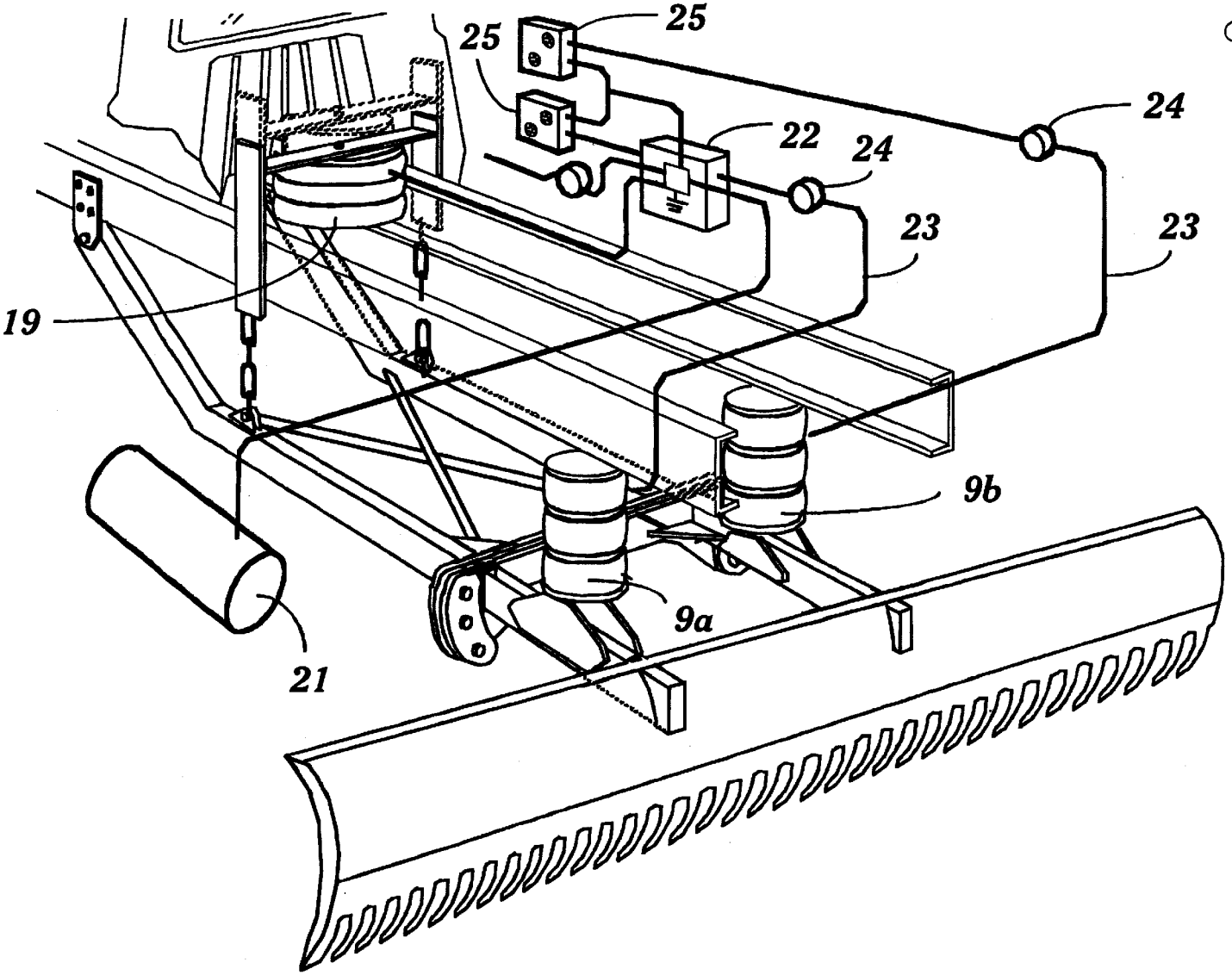
FIG. 5 depicts the vehicle of FIG. 2 with the air distribution and control system in place.

The control system for the blade support is depicted in FIG. 5. A source of pressurized air 21, depicted as an air tank, provides air to a pressure distribution box 22. Pressurized air is directed from this box 22 to the lifting bellows 19 and pressure actuator bellows 9*a*,9*b*, through air lines 23 in response to manually set input signals, preferably originating remotely from within the vehicle cab. Exhaust valves 24, responding in cooperation with the operation of the pressure distribution box 22, exhaust or vent air from bellows 9*a*,9*b*,19 when they are to be depressurized, e.g. venting lifting bellows 19 when pressure actuators 9*a*,9*b* are pressurized. Manometers 25 display the pressure conditions within the system.

Through the pressure distribution box 22, controlled levels of pressure may preferably be developed independently in each of the bellows 9*a*,9*b* controlling the scrapping effect of the blade 5 on the road surface. A different pressure need not necessarily be applied through the bellows 9*a*,9*b*; but such option is available.

Figure 6:
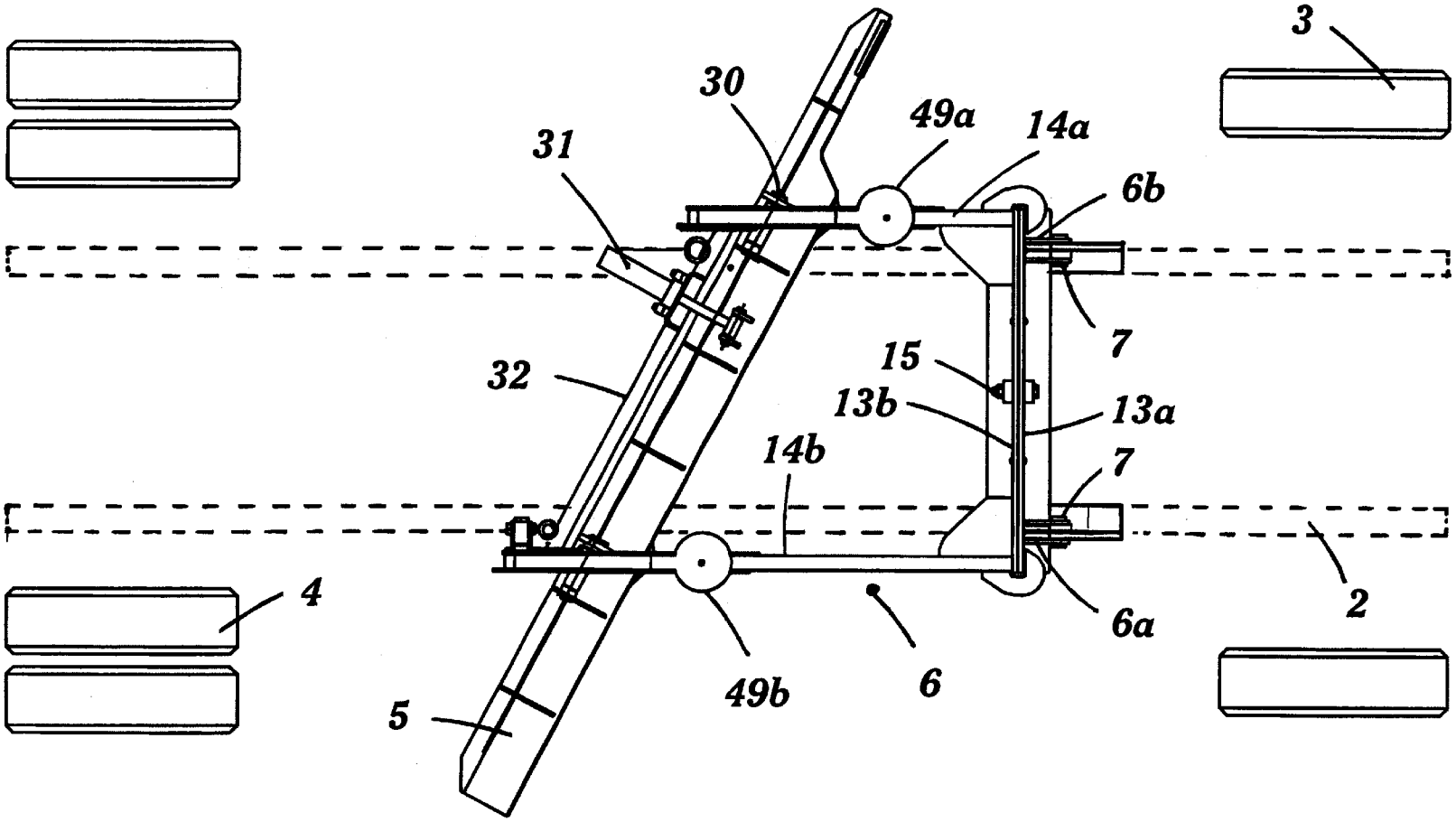
FIG. 6 is a plan view of the folding blade configuration of the invention.

The folding-blade feature of the invention is shown in plan view in FIG. 6. To assist in perceiving the positioning of the plow components, the wheels 3, 4 are depicted at disembodied locations in FIGS. 6, 7*a* and 7*b*.

Figure 7A:
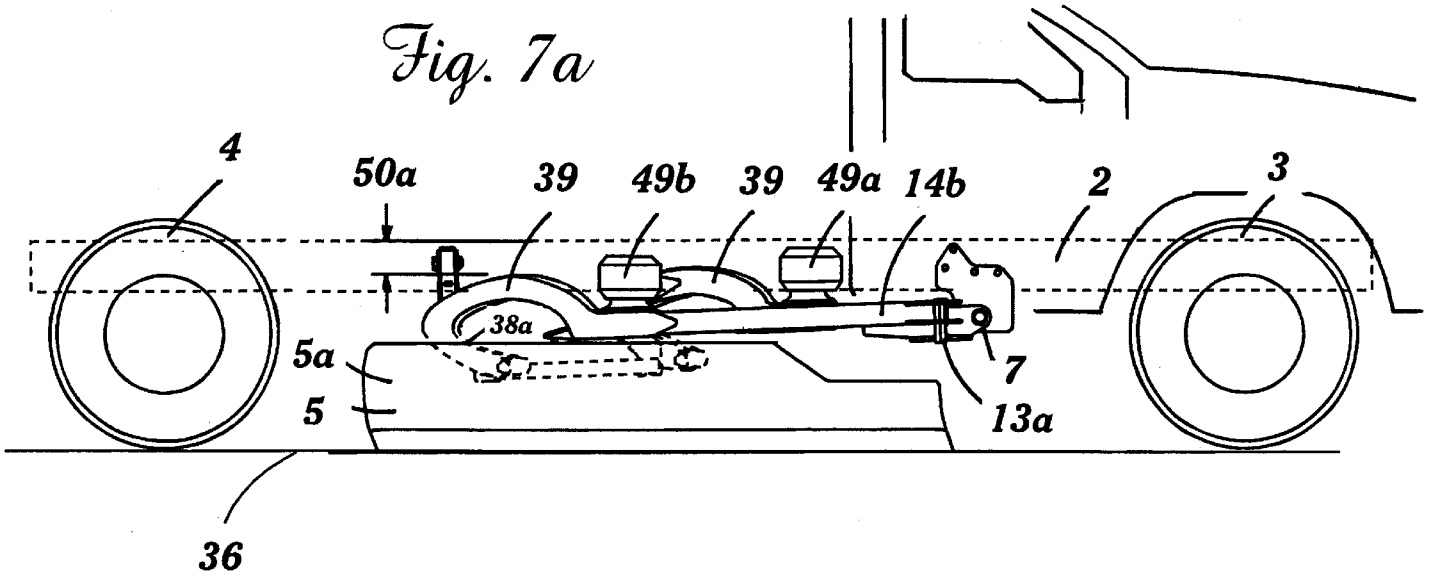
FIGS. 7*a* and 7*b* are side views of the blade of FIG. 6 respectively deployed and folded for storage.
Figure 7B:
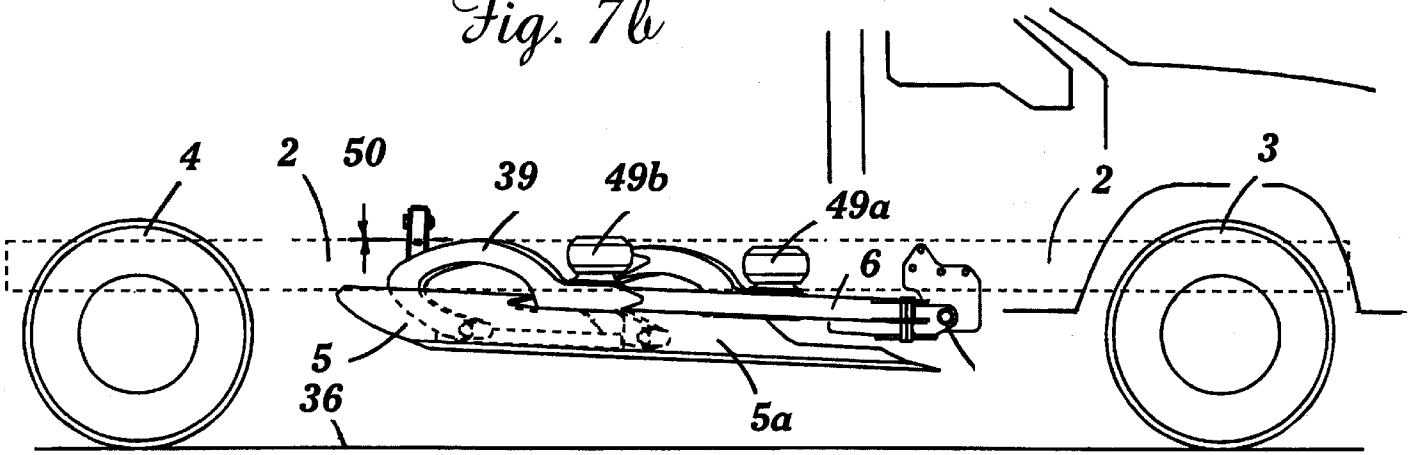

In FIGS. 6, 7*a* and 7*b* the tilting plates 13*a*, 13*b* have been shifted forwardly under the vehicle, to a location proximate to the pivot arm hinges 7. In this arrangement, the pivot arms 6*a*,6*b* are greatly shortened and the blade support arms 14*a*,14*b* are greatly lengthened. The freedom of action provided to permit the blade 5 to tilt is, however, the same in principle as described previously. For the further discussion following herein, the blade support arms 14*a*,14*b* will be addressed as forming part of the pivot arm assembly 6.

In FIG. 6 the blade 5 is fixed transversely to the chassis 2 at an angle, e.g. 28 degrees, out of alignment with the vehicle. The blade 5 is carried by the two support arms 14*a*,14*b* and respective air bladders 49*a*,49*b* are positioned to develop a downward thrust upon such arms 14*a*,14*b*.

The blade 5 has its own blade hinge axis 30 and is positioned by a cylinderical actuator 31 mounted on a transverse bar portion 32 of the pivot arm assembly 6. A linearly actuated shaft 33 extends from the actuator 31 to join with the blade 31 at a blade-actuator hinge 34. The blade hinge axis 30 is behind the blade 5, positioned intermediate of the upper edge 32 and the scrapping edge 37 of the blade 5.

The dual folding action of the blade 5 is shown in FIGS. 7*a* and 7*b* which respectively depict blade 5 as deployed and folded upwardly for storage. It will be noticed that, as a preferred feature, the support arms 14*a*,14*b* are also swung upwardly from their deployed position, in FIG. 7*a*, to their storage position, in FIG. 7*b*, when the blade 5 is folded upwardly with mold board 5*a* of the blade directed upwardly. The upward swing raises the arcuate portion 39 of the arms 14*a*, 14*b* closing-up the difference 50,50*a* shown in FIGS. 7*a*,7*b*.

Figure 8A:
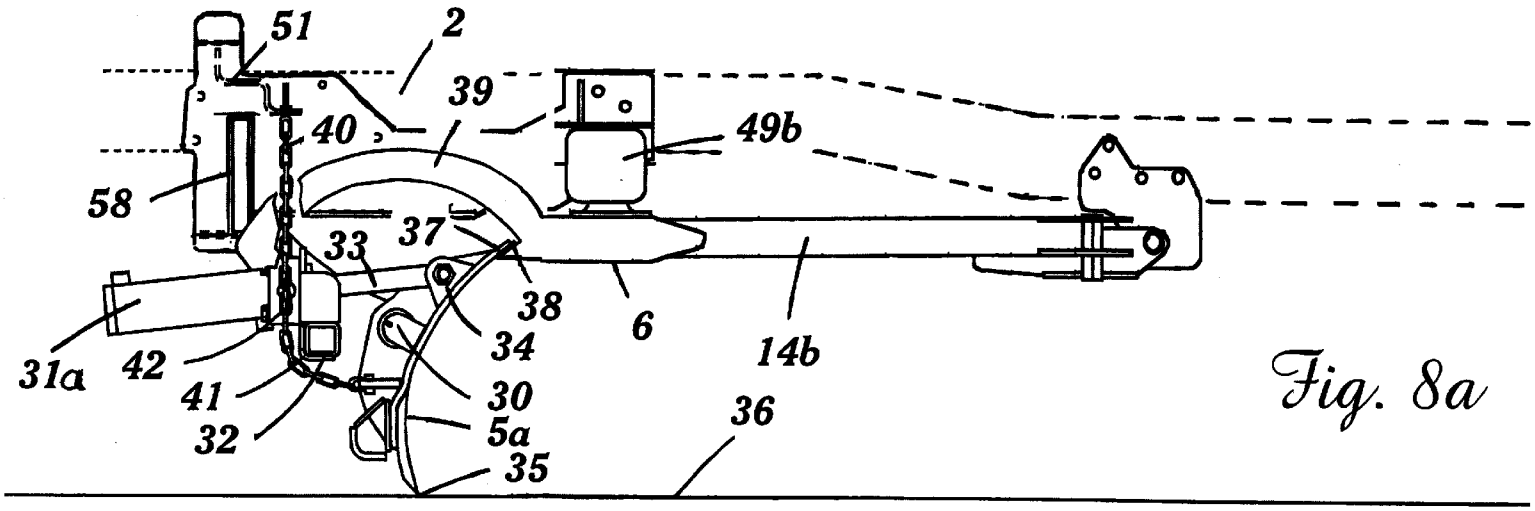
FIGS. 8*a* and 8*b* are side views along the blade respectively when deployed and when folded.
Figure 8B:
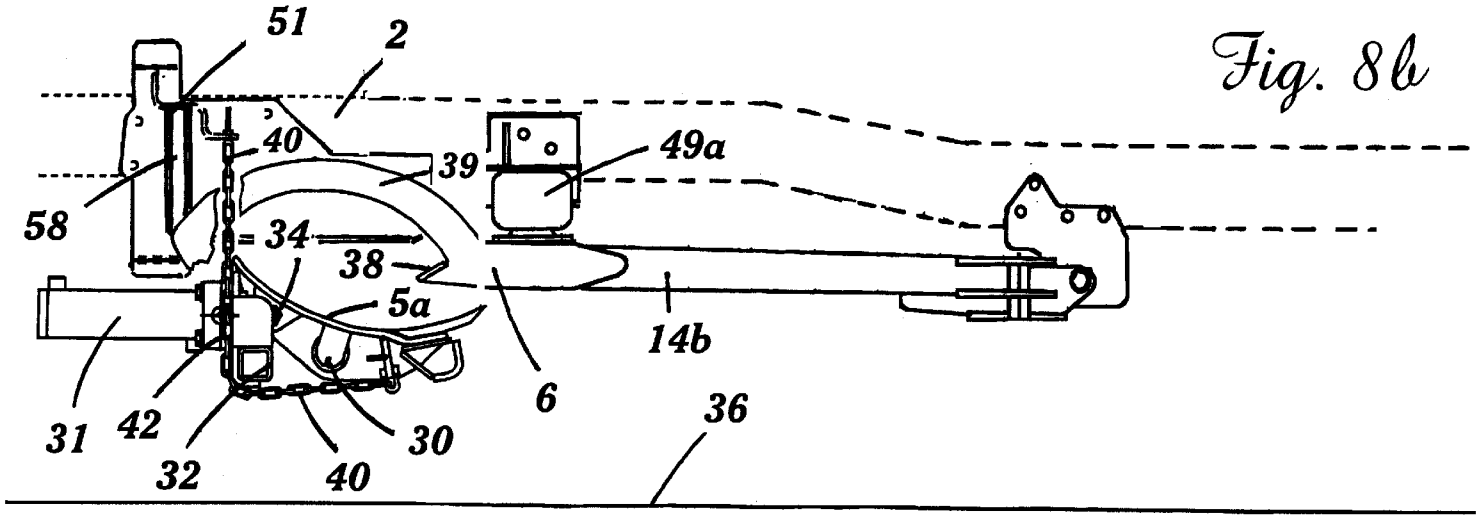

In FIGS. 8*a* and 8*b*, details of the blade-folding action are shown in side view, looking endwise along the blade 5. In FIG. 8*a* the blade 5 is deployed with its scraping edge 35 positioned on a road surface 36 and its upper edge 37 bearing against a blade-deployed rotational stop surface 38 positioned on arcuate portion 39 of the support arms 14*a*, 15*b* of the pivot arm assembly 6. The shaft 33 of the actuator 31 is fully extended, having carried the upper edge 37 of the blade 5 to the stop surface 38. Thus the rotational stop surface 38 absorbs the obstructions encountered by the blade 5 on the road surface 36, rather than the actuator 31.

In FIG. 8*b* the blade 5 is shown as folded, the upper edge 37 having passed rearwardly beneath arcuate portions 39 of the support arms 14*a*,14*b* upon retraction of the shaft 33 (not visible in FIG. 8*b*) to rest against folded-blade stop surface 38*a*. Rotating about blade hinge axis 30, the lower, scraping edge 35 is elevated above the road surface 36 to present the mold board 5*a* of the blade upwardly once the upper edge 37 reaches the folded-blade stop surface 38*a*.

To achieve a double-action lifting effect with a maximum economy of components, a linkage in the form of a chain 40 extending between the blade 5 and chassis 2 is tightened by the retraction of shaft 33 and the forward rotational advance of the lower half of the blade to which it is connected to serve as a blade elevating means. The action draws the support arms 14*a*,14*b* upwardly towards the chassis 2. The corner 41 formed on the transverse bar portion 32 of the pivot arm assembly 6 may be strengthened and shaped to permit the chain 40 to slide around this corner 41 during this lifting action. A stopping arm 58 connected to the transverse bar 32 rises until it abuts a chassis rest 51, limiting further upward travel of the blade 5 and pivot arm assembly 6.

Figure 9:
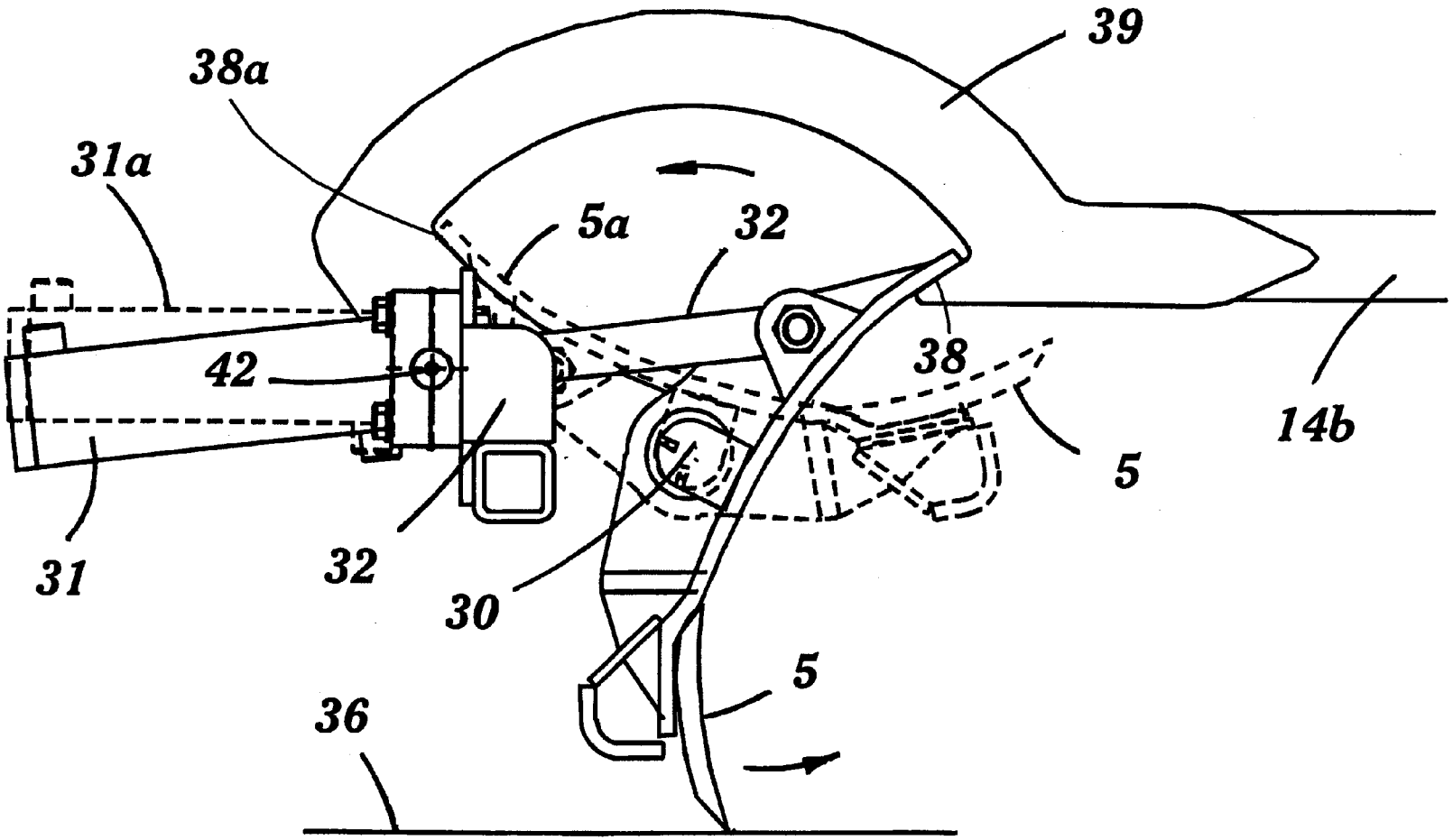
FIG. 9 is a detailed view of FIG. 8*a* showing the stored view of the blade of FIG. 8*b* in ghost outline.

As shaft 33 is not in an intersecting alignment with hinge axis 30, the linear actuator 31 is mounted to the transverse bar portion 32 by a swivelling support means that rotates about actuator axis 42 (indicated as to its location in FIGS. 8*a*, 8*b*). Thus the actuator 31 has differing orientations in FIGS. 8*a* and 8*b*. The difference in these orientations are shown in FIG. 9 wherein a ghost outline 31*a* shows the actuator 31 when the blade 5 is in its stored position.

Figure 10:
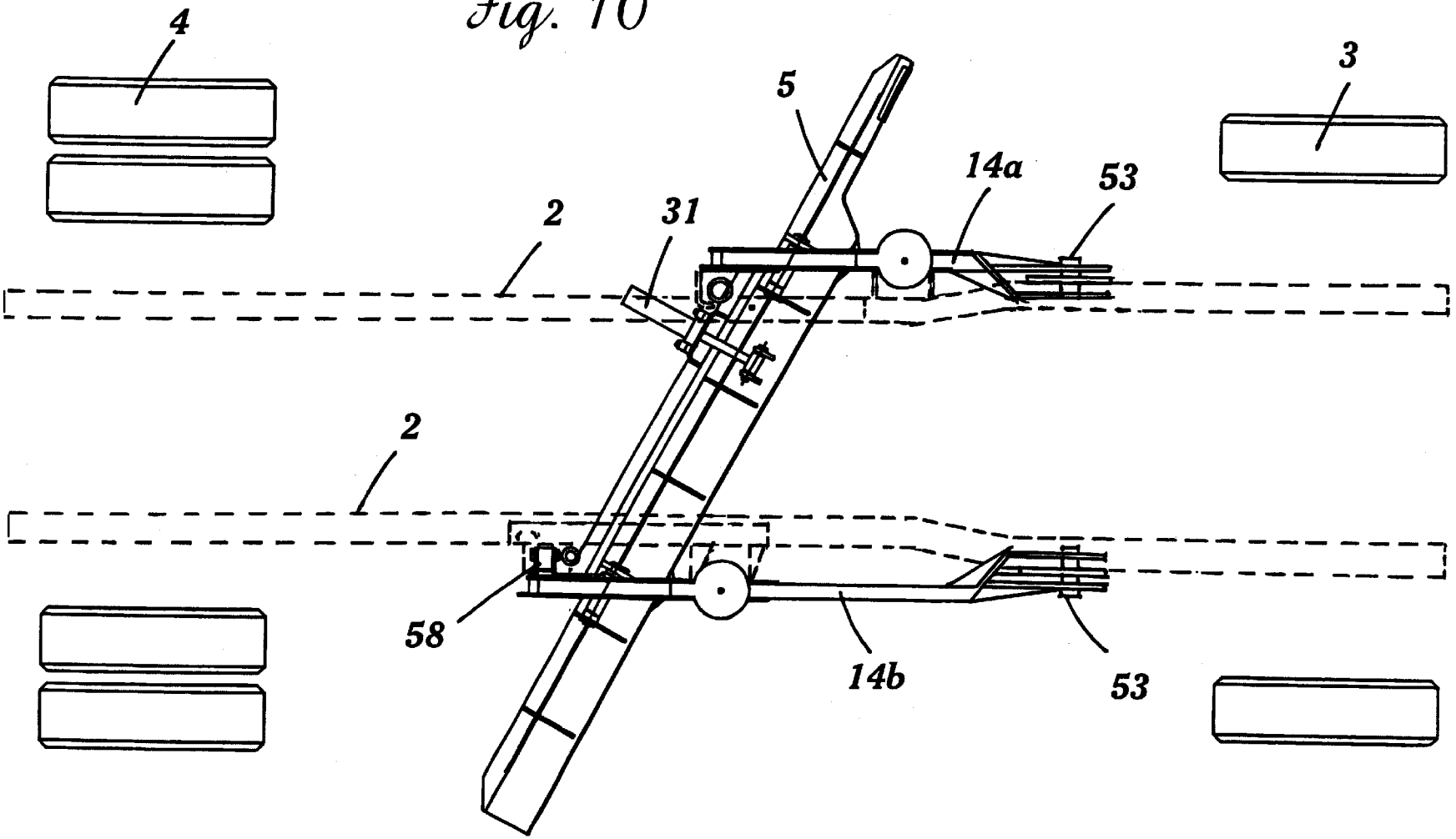
FIG. 10 is a plan view of a folding blade configuration of the invention having separately hinged pivot arms to provide the pivot arm assembly.

FIGS. 1 through 5 depict an environment in which the folding blade 5 of FIGS. 6 through 9 may be installed. In FIG. 10 the pivot arm assembly 6 is shown as being attached to the chassis 2 by independent hinge joints 53 as chassis mounting means. These joints 53, optionally of the Torrington type, allow the pivot arms 14*a*, 14*b* to rotate independently. This dispenses with the need for tilting plates 13*a*, 13*b*.

As shown in FIG. 10, a side surface (not numbered) of the stopping arm 58 may bear against a portion of the chassis 2 to limit sideways displacement of the blade 5 and pivot arms 14*a*, 14*b*.

The combined effect of both folding the blade 5 to direct its mold board 5*a* upwardly and swinging the support arms 14*a*,14*b* upwardly allows the blade 5 to be stored with maximum elevation under the chassis 2. This is highly desirable as it allows the vehicle to travel at high speeds over uneven road surfaces 36 with reduced risk that the stored blade 5 will contact a protruding portion of the road surface 36 or strike an object lying on the road.

The use of air-activated pressure actuators 9*a*,9*b* renders the blade support of the invention light in weight and less costly than hydraulic systems. The light weight of the blade 5 and pivot arm assembly 6 is supplemented by pressure applied through the bellows 9*a*,9*b*, 49*a*,49*b* which respond resiliently to variations in the height of the road surface 36. The rotary coupling 12 of the tilting plates 13*a*,13*b* in the pivot arm assembly 6, or the use of flexible Torrington-type joints 53, allows the scrapper blade 5 to adjust to the contour of the road surface 36 in the preferred variants of the invention. The angled orientation of the blade 5 allows debris to be transferred to the left or right side of the vehicles. Individually and collectively an improved means is provided for clearing a road surface.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A plow assembly for mounting on a vehicle for grading and snow removal, said vehicle having a chassis with forward and rearward ends and forward and rearward wheels, comprising:

a. chassis mounting means;

b. a blade mounted by blade support means beneath the chassis mounting means for positioning of the blade between the forward and rearward wheels of a vehicle, said blade having a forward mold board face surface, two outer ends, a lower scrapping edge and an upper edge;

c. a blade-folding hinge with a folding hinge axis extending in parallel alignment with the blade said hinge being carried by the blade support means;

d. blade positioning means carried by the blade support means and extending to the blade to position the blade about the folding hinge axis; and e. A rotational stop surface carried by the blade support means whereby the blade, when stored, is folded by swinging the scrapping edge upwardly and forwardly about the folding hinge axis with the mold board face surface upwardly directed and, when deployed with the mold board face surface forwardly directed and the lower scrapping edge presented for scrapping a road surface, the blade bears against said rotational stop surface.

2. A plow assembly as in claim 1 wherein said blade support means comprises tilt rotational means to allow the blade to tilt, whereby one of the outer ends of the blade may be elevated with respect to the other.

3. A plow assembly as in claim 1 wherein said blade support means comprises a pivot arm assembly having forward and rearward ends and mounted at its forward end to said chassis mounting means for rotation about a pivot arm axis, said pivot arm assembly carrying the blade and blade-folding hinge at its rearward end.

4. A plow assembly as in claim 3 comprising resilient pressure actuator means positioned on the upper side of the pivot arm assembly to apply, when the plow assembly is installed beneath the chassis of a vehicle, downward pressure to the blade directing the scraping edge to press resiliently against a road surface beneath the vehicle.

5. A plow assembly as in claim 4 wherein said blade support means comprises tilt rotational means to allow the blade to tilt, whereby one of the outer ends of the blade may be elevated with respect to the other.

6. A plow assembly as in claim 4 wherein the pressure actuator means comprises pneumatic bladders.

7. A plow assembly as in claim 5 wherein the pressure actuator means comprises pneumatic bladders.

8. A plow assembly as in claim 1 in combination with a vehicle having a chassis beneath which the plow assembly is mounted comprising a blade elevating means coupled between said blade support means and said chassis to elevate the blade by drawing the blade towards the chassis when the blade positioning means acts to swing the scrapping edge upwardly.

9. A plow assembly as in claim 2 in combination with a vehicle having a chassis beneath which the plow assembly is mounted comprising a blade elevating means coupled between said blade support means and said chassis to elevate the blade by drawing the blade towards the chassis when the blade positioning means acts to swing the scrapping edge upwardly.

10. A plow assembly as in claim 3 in combination with a vehicle having a chassis beneath which the plow assembly is mounted comprising a blade elevating means coupled between said pivot arm assembly and said chassis to elevate the blade by drawing the blade towards the chassis when the blade positioning means acts to swing the scrapping edge upwardly.

11. A plow assembly as in claim 4 in combination with a vehicle having a chassis beneath which the plow assembly is mounted comprising a blade elevating means coupled between said pivot arm assembly and said chassis to elevate the blade by drawing the blade towards the chassis when the blade positioning means acts to swing the scrapping edge upwardly.

12. A plow vehicle as in claim 1 wherein said rotational stop surface bears against the upper edge of the blade when the blade is deployed for scrapping a road surface.

13. A plow assembly as in claim 2 wherein said rotational stop surface bears against the upper edge of the blade when the blade is deployed for scrapping a road surface.

14. A plow assembly as in claim 3 wherein said rotational stop surface bears against the upper edge of the blade when the blade is deployed for scrapping a road surface.

15. A plow assembly as in claim 4 wherein said rotational stop surface bears against the upper edge of the blade when the blade is deployed for scrapping a road surface.

16. A plow assembly as in claim 1 in combination with a vehicle having a chassis beneath which the plow assembly is mounted.

17. A plow assembly as in claim 2 in combination with a vehicle having a chassis beneath which the plow assembly is mounted.

18. A plow assembly as in claim 3 in combination with a vehicle having a chassis beneath which the plow assembly is mounted.

19. A plow assembly as in claim 4 in combination with a vehicle having a chassis beneath which the plow assembly is mounted.

20. A plow assembly as in claim 5 in combination with a vehicle having a chassis beneath which the plow assembly is mounted.

* * * * *